US009388699B2

(12) United States Patent
Dong et al.

(10) Patent No.: US 9,388,699 B2
(45) Date of Patent: Jul. 12, 2016

(54) CROSSOVER COOLED AIRFOIL TRAILING EDGE

(71) Applicants: Zhirui Dong, Simsponville, SC (US); Xiuhang James Zhang, Simpsonville, SC (US); Melbourne James Myers, Duncan, SC (US); Camilo Andres Sampayo, Greer, SC (US)

(72) Inventors: Zhirui Dong, Simsponville, SC (US); Xiuhang James Zhang, Simpsonville, SC (US); Melbourne James Myers, Duncan, SC (US); Camilo Andres Sampayo, Greer, SC (US)

(73) Assignee: General Electric Company, Schenectady, NY (US)

( * ) Notice: Subject to any disclaimer, the term of this patent is extended or adjusted under 35 U.S.C. 154(b) by 521 days.

(21) Appl. No.: 13/961,194

(22) Filed: Aug. 7, 2013

(65) Prior Publication Data

US 2015/0040582 A1 Feb. 12, 2015

(51) Int. Cl.
*F01D 5/18* (2006.01)
*F01D 5/14* (2006.01)

(52) U.S. Cl.
CPC ..... *F01D 5/147* (2013.01); *F01D 5/186* (2013.01); *F01D 5/187* (2013.01)

(58) Field of Classification Search
CPC ..... F01D 5/186; F01D 5/187; F05D 2230/60
See application file for complete search history.

(56) References Cited

U.S. PATENT DOCUMENTS

| | | | | | |
|---|---|---|---|---|---|
| 4,073,599 | A * | 2/1978 | Allen | F01D 5/187 | 416/232 |
| 4,180,373 | A * | 12/1979 | Moore | F01D 5/187 | 415/115 |
| 4,474,532 | A * | 10/1984 | Pazder | F01D 5/187 | 415/115 |
| 4,767,268 | A * | 8/1988 | Auxier | F01D 5/187 | 415/115 |
| 5,395,212 | A * | 3/1995 | Anzai | F01D 5/187 | 415/115 |
| 5,603,606 | A * | 2/1997 | Glezer | F01D 5/187 | 415/115 |
| 6,174,134 | B1 | 1/2001 | Lee et al. | | |
| 6,607,356 | B2 | 8/2003 | Manning et al. | | |
| 6,916,155 | B2 * | 7/2005 | Eneau | F01D 5/186 | 415/115 |
| 6,932,573 | B2 * | 8/2005 | Liang | F01D 5/187 | 415/115 |
| 7,104,757 | B2 * | 9/2006 | Gross | F01D 5/187 | 415/115 |
| 7,300,250 | B2 * | 11/2007 | Papple | F01D 5/187 | 416/96 R |
| 7,780,415 | B2 * | 8/2010 | Liang | F01D 5/186 | 415/115 |
| 7,967,563 | B1 * | 6/2011 | Liang | F01D 5/186 | 415/115 |

* cited by examiner

*Primary Examiner* — Igor Kershteyn
(74) *Attorney, Agent, or Firm* — Nixon & Vanderhye P.C.

(57) ABSTRACT

A cooling circuit for a turbine bucket having an airfoil portion includes a trailing edge cooling circuit portion provided with a first radially outwardly directed inlet passage intermediate leading and trailing edges of the airfoil portion of the bucket, extending from a platform portion of the bucket to a location adjacent a radially outer tip of the bucket, and connecting to a second radially inwardly directed passage extending from a location adjacent the radially outer tip to a location adjacent the platform portion. The second radially inwardly directed passage connects to a third trailing edge region passage, and a plurality of crossover passages connect a radially outer half of the second radially inwardly directed passage to a radially outer half of the third trailing edge region passage.

20 Claims, 4 Drawing Sheets

CROSSOVER COOLED AIRFOIL TRAILING EDGE

BACKGROUND OF THE INVENTION

The present invention relates generally to gas turbine engines and, more specifically, to the cooling of turbine blades or buckets supported on one or more gas turbine rotor wheels.

In a gas turbine engine, air is pressurized in a compressor, mixed with fuel in one or more combustors and ignited to thereby generate hot combustion gases. Energy is extracted from the combustion gases in one or more turbine stages disposed downstream of the combustors.

Each turbine stage includes a stationary turbine nozzle having a row of vanes or blades which direct the combustion gases to a cooperating row of turbine buckets mounted on a wheel fixed to the turbine rotor. The turbine buckets are typically hollow (or cast with internal passages or channels) and are provided with air bled from the compressor (compressor discharge or extraction air) for cooling the buckets during operation.

Bucket airfoils have a generally concave pressure side and an opposite and generally convex suction side extending generally axially between leading and trailing edges, and radially from a platform to an outer tip.

In view of the three-dimensional, complex combustion gas flow distribution over the bucket airfoils, the different portions thereof are subjected to different heat loads during operation. The very high temperatures generate thermal stresses in the airfoils which must be suitably limited in order to prolong the service life of the airfoils and hence the buckets.

The airfoils are typically manufactured from superalloy cobalt- or nickel-based materials having sustained strength under high temperature operation. As noted above, the useful life of the buckets is limited, however, by the maximum stresses and high temperatures experienced by the airfoil portions of the buckets.

Accordingly, the prior art describes various internal cooling channels or circuits, some of which incorporate different forms of heat transfer-increasing turbulator ribs, pins or the like for cooling the various portions of the airfoil.

For example, U.S. Pat. No. 6,174,134 (Lee et al.), assigned to applicant, discloses an airfoil cooling configuration for effecting enhanced cooling of the trailing edge area of the airfoil. Cooling air flowing radially outwardly in a passage adjacent the trailing edge is channeled by multiple crossover holes into a cavity extending along the trailing edge.

In U.S. Pat. No. 6,607,356, the turbine airfoil includes pressure and suction sidewalls having first and second cooling circuits disposed therebetween, separated by a longitudinally, i.e., radially, extending bridge. The aft or trailing edge circuit includes a bridge formed with a row of inlet holes extending along the length of the bridge, allowing radially outwardly-directed flow in one channel of the circuit to crossover into a second channel closer to the trailing edge.

In a continuing search for improved cooling circuits that provide enhanced cooling with efficient use of compressor air, it has been determined an internal bucket cooling circuit that supplies lower temperature cooling medium to the bucket trailing edge region or cavity, and especially to a known hotspot at the outer tip of the trailing edge region would be desirable.

BRIEF SUMMARY OF THE INVENTION

In one exemplary but nonlimiting embodiment, there is provided a cooling circuit for a turbine bucket having an airfoil portion comprising: a trailing edge cooling circuit portion including a first radially outwardly directed passage intermediate leading and trailing edges of the airfoil portion of the bucket, extending from a platform portion of the bucket to a location adjacent a radially outer tip of the bucket, and connecting to a second radially inwardly directed passage extending from a location adjacent the radially outer tip to a location adjacent the platform portion, the second radially inwardly directed passage connecting to a third trailing edge region passage; wherein a plurality of crossover passages connect a radially outer half of the second radially inwardly directed passage to a radially outer half of the third trailing edge region passage.

In another aspect of the exemplary but nonlimiting embodiment, there is provided a gas turbine system comprising a compressor, one or more combustors, at least one turbine stage and a generator, a rotor extending axially through the compressor and the at least one turbine stage; at least one rotor wheel fixed to the rotor and mounting a plurality of buckets extending about a periphery of the at least one rotor wheel, each of the plurality of buckets provided with a trailing edge cooling circuit portion including a first radially outwardly directed inlet passage intermediate leading and trailing edges of an airfoil portion of the bucket, extending from a platform portion of the bucket to a location adjacent a radially outer tip of the bucket, and connecting to a second radially inwardly directed passage extending from the location adjacent the radially outer tip to a location adjacent the platform portion, the radially inwardly directed passage connecting to a trailing edge region cavity; wherein a plurality of crossover passages connect a radially outer half of the second radially inwardly directed passage to a radially outer half of the trailing edge region cavity.

In still another aspect, the invention relates to a method of cooling a targeted area within a radially outer portion of an airfoil portion of a bucket comprising:

a. supplying cooling air to an internal, serpentine cooling circuit in the bucket airfoil providing at least two radially outward flow paths and a radially inward flow path therebetween, and b. diverting at least some cooling air at a radially outward end of the radially inward flow path directly into a radially outer end of the radially outward flow path proximate the trailing edge of the airfoil to thereby preferentially cool a targeted area in a radially outer area of the trailing edge region.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
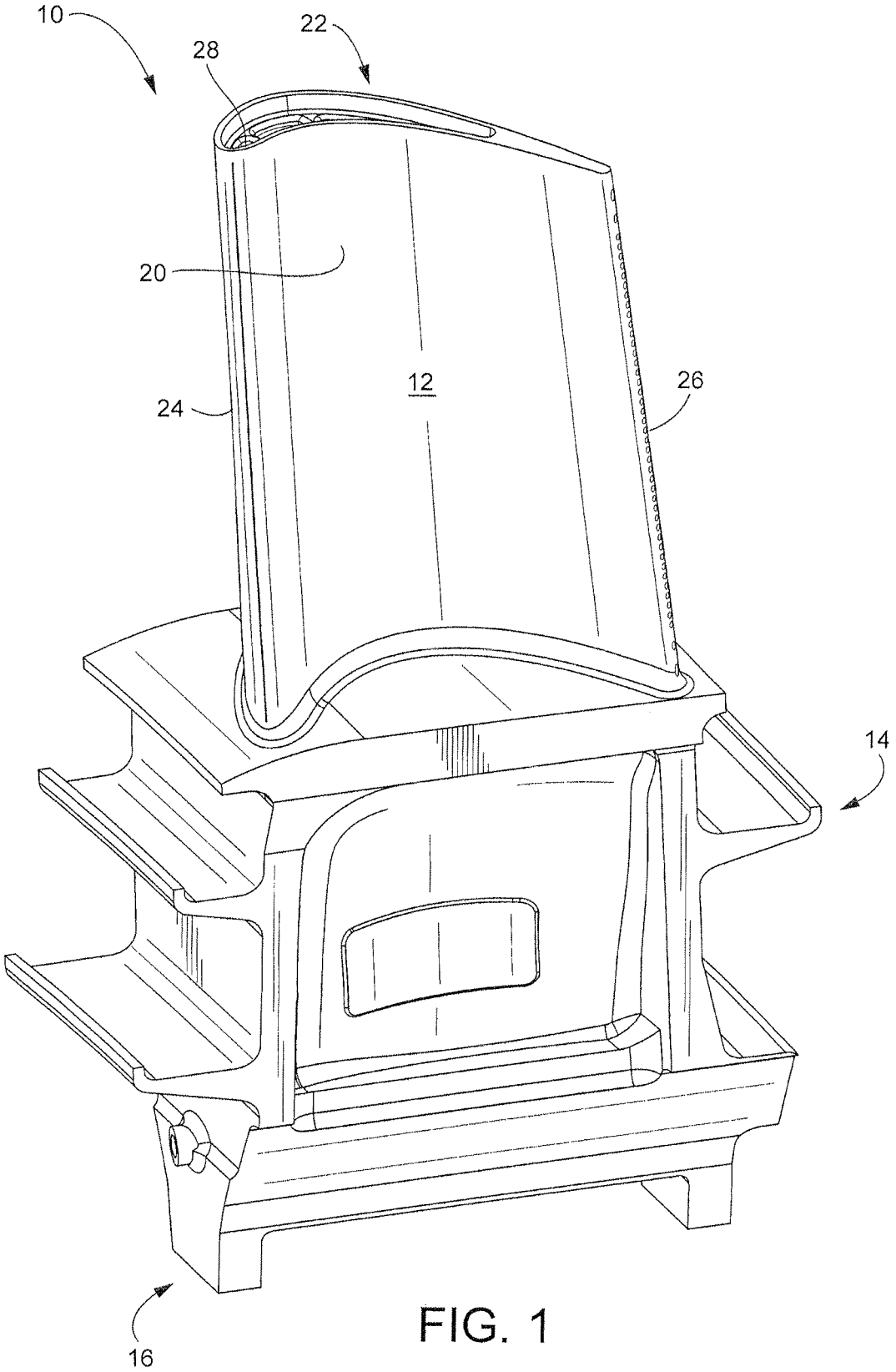
FIG. 1 is a perspective view of a turbine bucket incorporating a cooling circuit in accordance with a first exemplary but nonlimiting embodiment of the invention.

Illustrated in FIG. 1 is an exemplary first stage turbine rotor blade or bucket 10 of a gas turbine engine. The bucket 10 includes an airfoil 12, a platform and shank portion 14, and an integral dovetail 16 or other mounting configuration for mounting the blade in a corresponding mating or complimentary slot in the perimeter of a turbine rotor wheel (not shown).

The airfoil 12 is conventionally configured for extracting energy from hot combustion gases which are channeled thereover during operation to rotate the turbine rotor and thus power the compressor, generator and/or other load. The airfoil 12 receives a portion of the compressor air through the dovetail (or other mounting configuration) for cooling the interior of the airfoil during operation.

The airfoil 12 illustrated in FIG. 1 includes a generally concave first or pressure side 20 and a generally convex, second or suction side 22. The two sides are joined together along axially or chordally opposite leading and trailing edges 24, 26 respectively, which extend radially to the outer tip 28. The airfoil 12, platform/shank 14 and mounting portion 16 are typically formed as a unitary casting, incorporating the internal cooling circuit(s).

Figure 2:
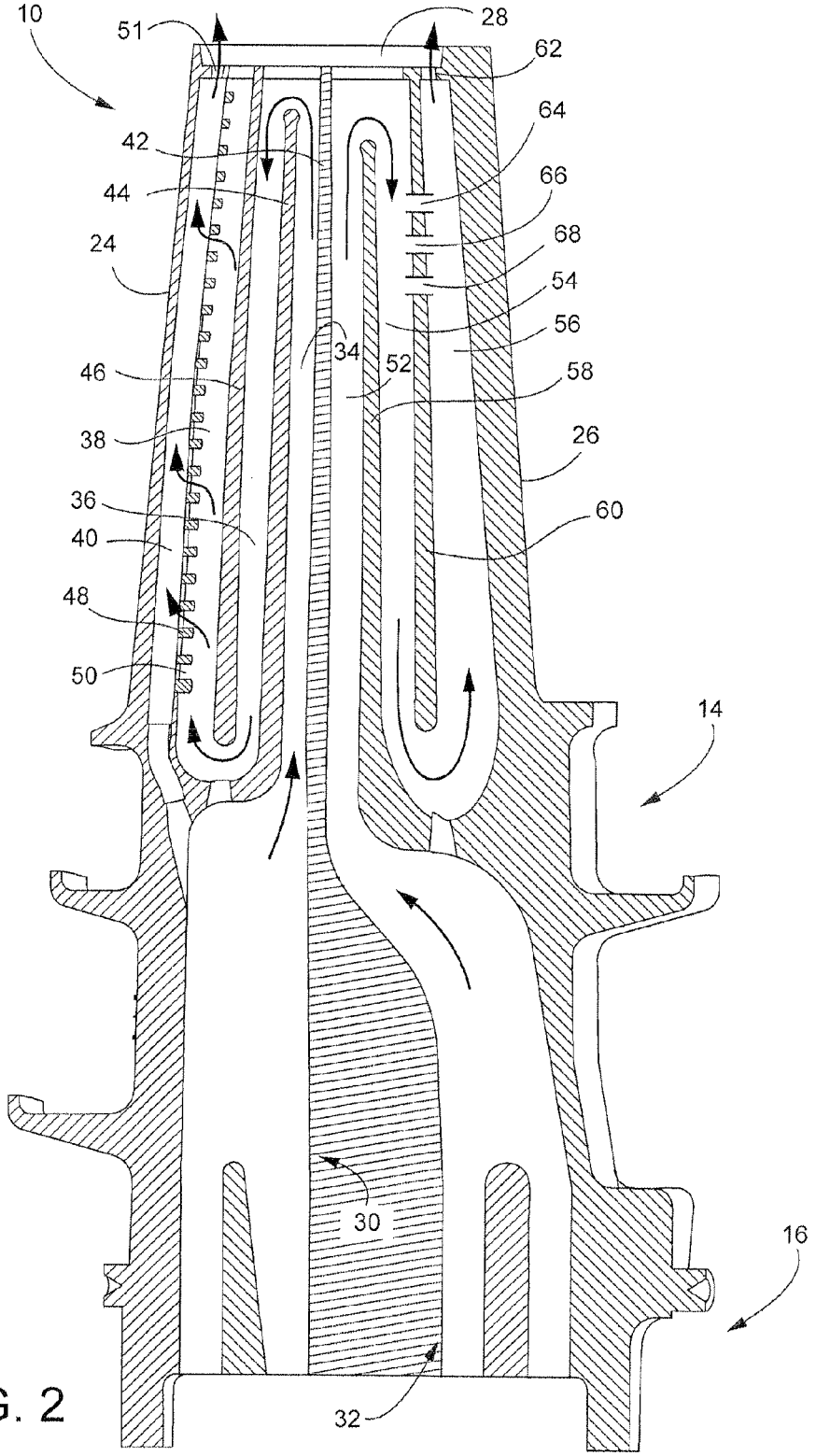
FIG. 2 is a vertical section view taken through the bucket illustrated in FIG. 1, but with the bucket rotated about its longitudinal axis about fourty five degrees in a clockwise direction.

Specifically, and with reference to FIG. 2, the interior of the airfoil is formed to include a pair of cooling circuits 30, 32. The forward circuit 30 is configured to cool the interior region of the airfoil closer to the leading edge 24, while the rearward or aft circuit 32 is configured to cool the interior region of the airfoil closer to the trailing edge 26. Thus, it will be understood that reference to, for example, a trailing edge cooling circuit embraces circuits in the vicinity or region of the trailing edge, and not necessarily a circuit extending along and closely adjacent the trailing edge.

The forward circuit 30 has a serpentine shape, with three cavities or radially-oriented flow passages 34, 36, 38 with an inlet near the middle of the airfoil (i.e., approximately midway between the leading and trailing edges 24, 26, respectively), winding toward the airfoil leading edge 24. The circuit 30 also includes a dedicated cavity or flow passage 40 directly behind or adjacent the leading edge 24. The respective radial "bridges" 42, 44, 46 and 48 defining the cavities or flow passages 34, 36, 38 and 40, repectively, are imperforate, except for the forward-most bridge 48 which includes a row of impingement holes 50 for diverting some of the cooling air from the adjacent cavity or flow passage 38 into the leading edge cooling cavity or channel 40 to cool the leading edge of the airfoil. Specifically, the cooling air flows radially outwardly in the passage 34, reverses direction at the tip 28 and then flows radially inwardly in flow passage 36. The flow again reverses direction at the radially inner end of the passage 36 and flows radially outwardly in the flow passage 38, supplying cooling air to the cavity 40 via apertures 50, and then exiting the airfoil at the tip 28 via outlet opening 51.

The aft cooling circuit 32 is also a serpentine, three-pass circuit in which the radially-oriented flow passages 52, 54 and 56 thereof are also defined by imperforate radial bridges 42, 58 and 60, with the first passage 52 of the aft serpentine circuit 32 similarly receiving its inlet air near the middle of the airfoil through the dovetail. Note that the radial bridge 42 extends radially to the airfoil outer tip 28, thus separating (i.e., isolating) the cooling circuits 30, 32 downstream of the common inlet at 33.

In the preferred embodiment, the cooling air is directed radially outwardly in the first aft circuit flow passage 52, reversing direction at the outer tip 28 into the second flow passage 54. The cooling air flows radially inwardly in the passages 54 and reverses into the third flow passage 56 where the cooling air flows radially outwardly, exiting the tip aperture 62. Flow passage or cavity 56 communicates with the flow passage or cavity 54 by means of crossover channels or holes 64, 66 and 68 located in the radially outer portion (i.e., the radially outer half and preferably the outer quarter) of the bridge 60. The number (e.g., between 2 and 6) of crossover channels or holes (or tubes) and their respective location in the bridge or bridge wall 60, as well as the cross-sectional shape of the holes (for example, round or oval) may vary with specific applications. The spacing between the crossover channels may be uniform or non-uniform, again depending on specific applications.

In this manner, it is possible to direct cooler air to a known hotspot or target area at the radially-outer end of the flow passage or cavity 56 proximate the trailing edge 26, by diverting some of the air in passage 54 directly to the hotspot area. In other words, absent the crossover channels 64, 66 and 68, the cooling circuit air flowing across the hotspot area would be warmer because of heat absorbed along the full radial length of the flow passage 56. The crossover channels 64, 66 and 68 thus provide cooler air to the hotspot area by bypassing portions of the passages 54 and 56 that would otherwise add additional heat to the cooling air.

Figure 3:
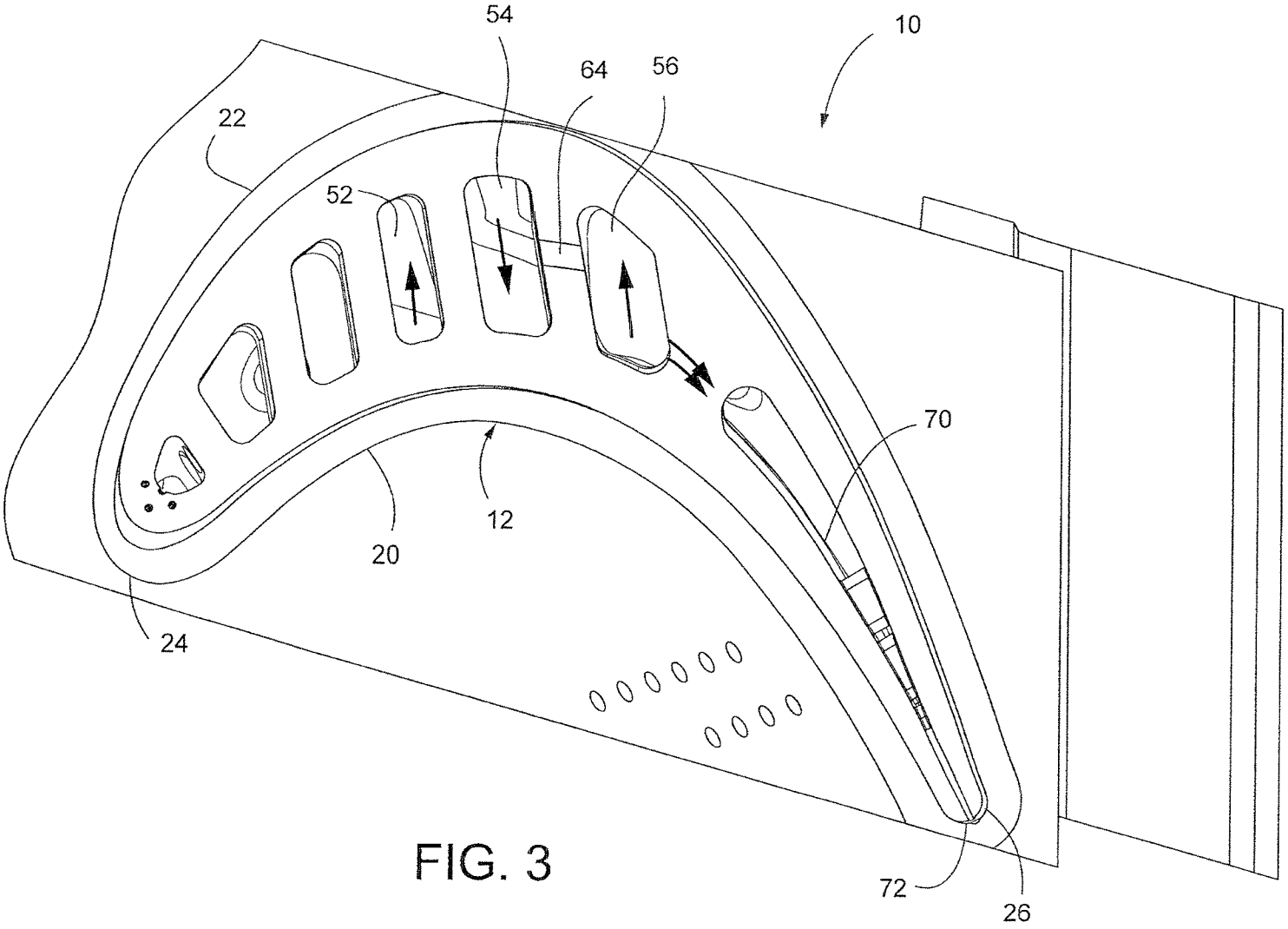
FIG. 3 is a top plan view of the bucket illustrated in FIG. 1.

It will be appreciated that some or all of the flow passages or cavities may be provided with any known turbulator features for increasing heat transfer effectiveness of the cooling air channeled therethrough. In addition, the pressure and suction sides and or leading and trailing edges of the airfoil typically include various rows of film cooling holes through which respective portions of the cooling air are discharged during operation for providing film cooling of various targeted portions of the outer surface of the airfoil for additional protection against the hot combustion gases in an otherwise conventional manner. For example, from FIG. 3 it can be seen that additional generally axially-oriented holes or channels 70 that communicate with the passage 56 direct a portion of the cooling air to the trailing edge 26 where it exits film cooling holes 72 (see also FIG. 1).

Figure 4:
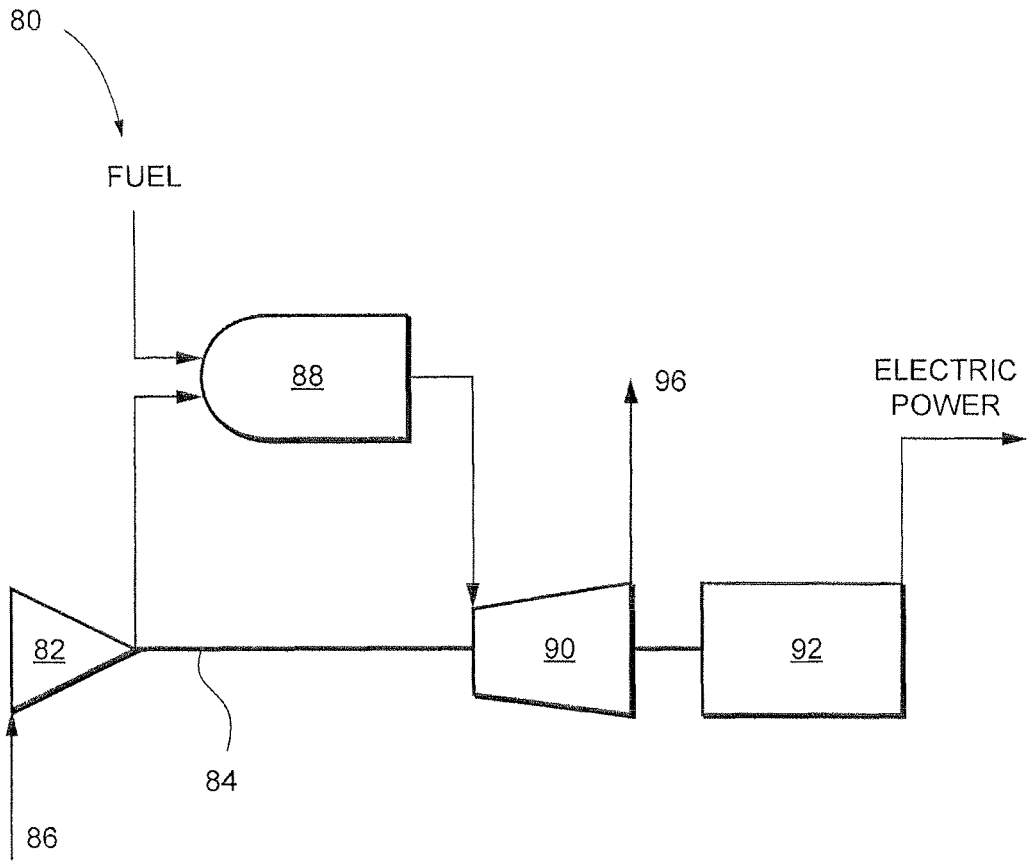
FIG. 4 (PRIOR ART)
FIG. 4 is a schematic diagram of a gas turbine system that may incorporate vanes, blades and or buckets in accordance with the exemplary embodiment described herein.

FIG. 4 illustrates in schematic form a gas turbine system 80 that includes vanes, blades and buckets that may incorporate the cooling circuits described above. In this otherwise conventional arrangement, air supplied via inlet 86 is pressurized in a compressor 82 and mixed with fuel in one or more combustors 88 where it is ignited to thereby generate hot combustion gases. Energy is extracted from the combustion gases in turbine stages 90 disposed downstream of the combustors to drive a generator 92 producing electric power. The extracted energy may also be used to drive the compressor 82, and note that the turbine rotor 84 may be common to the compressor, turbine stages and generator. The invention described herein, however, is not limited to just the illustrated gas turbine system. Further in that regard, the cooling circuits described herein are fully compatible with various film-cooling configurations utilizing air flowing through the cooling circuit passages or cavities.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cooling circuit for a turbine bucket having an airfoil portion comprising: a trailing edge cooling circuit portion including a first radially-oriented passage intermediate leading and trailing edges of said airfoil portion of said bucket, extending from a platform portion of the bucket to a location adjacent a radially outer tip of the bucket for radial outward flow of a cooling medium, and connecting to a second radially-oriented passage extending from a location adjacent the radially outer tip to a location adjacent the platform portion for radial inward flow of the cooling medium, the second radially-oriented passage connecting to a third radially-oriented trailing edge region passage for radial outward flow of the cooling medium; wherein a plurality of crossover passages connect a radially outer half of the second radially-oriented passage to a radially outer half of the third radially-oriented, trailing edge region passage.

2. The cooling circuit for a turbine bucket of claim 1 wherein the plurality of crossover passages connect a radially outer quarter of the second radially-oriented passage to a radially outer quarter of the radially-oriented trailing edge region passage.

3. The cooling circuit for a turbine bucket of claim 1 wherein said plurality of crossover passages have round or oval cross sectional shapes.

4. The cooling circuit for a turbine bucket of claim 1 wherein said plurality of crossover passages is uniformly or non-uniformly spaced from each other in a radial direction.

5. The cooling circuit for a turbine bucket of claim 1 wherein said plurality of crossover passages comprise between two and six passages.

6. The cooling circuit for a turbine bucket of claim 1 wherein said plurality of crossover passages are comprised of tubes.

7. The cooling circuit for a turbine bucket of claim 1 further comprising a discrete forward cooling circuit isolated from said trailing edge circuit but supplied with cooling air from a common source.

8. A gas turbine system comprising a compressor, one or more combustors, at least one turbine stage and a generator, a rotor extending axially through the compressor and the at least one turbine stage; at least one rotor wheel fixed to said rotor and mounting a plurality of buckets extending about a periphery of said at least one rotor wheel, each of said plurality of buckets provided with a trailing edge cooling circuit including a first radially-oriented passage intermediate leading and trailing edges of an airfoil portion of the bucket, extending from a platform portion of the bucket to a location adjacent a radially outer tip of the bucket, and connecting to a second radially-oriented passage extending from the location adjacent the radially outer tip to a location adjacent the platform portion, the second radially-oriented passage connecting to a radially-oriented trailing edge region cavity; wherein a plurality of crossover passages connect only a radially outer half of the second radially-oriented passage to a radially outer half of the radially-oriented trailing edge region cavity.

9. The gas turbine system of claim 8 wherein the plurality of crossover passages connect only a radially outer quarter of the second radially-oriented passage to a radially outer quarter of the radially-oriented trailing edge region cavity.

10. The gas turbine system of claim 8 wherein said plurality of crossover passages have round or oval cross sectional shapes.

11. The gas turbine system of claim 8 wherein said plurality of crossover passages are uniformly or non-uniformly spaced from each other in a radial direction.

12. The gas turbine system of claim 8 wherein said plurality of crossover passages comprise between two and six passages.

13. The gas turbine system of claim 8 wherein said plurality of crossover passages are comprised of tubes.

14. The gas turbine system of claim 8 further comprising a discrete leading edge circuit isolated from said trailing edge circuit but supplied with cooling air from a common source.

15. The gas turbine system of claim 8 wherein plural film cooling holes extend from said trailing edge region cavity to said trailing edge.

16. A method of cooling a targeted area within a radially outer portion of an airfoil portion of a bucket comprising:

a. supplying cooling air to an internal, serpentine cooling circuit in an aft region of the bucket airfoil providing at least two radially outward flow paths and a radially inward flow path therebetween, and b. diverting at least some cooling air at a radially outward end of the radially inward flow path directly into a radially outer end of the radially outward flow path proximate the trailing edge of the airfoil to thereby preferentially cool a targeted area in a radially outer area proximate the trailing edge.

17. The method of claim 16 wherein step b. is achieved by providing a plurality of crossover passages connecting a radially outer quarter of the radially inward flow path to a radially outer quarter of the radially outward flow path.

18. The method of claim 17 wherein between 2 and 6 crossover passages are provided, said crossover passages, each formed with round or oval cross-sectional shapes.

19. The method of claim 16 wherein a discrete second cooling circuit is provided in a forward region of the bucket airfoil.

20. The method of claim 16 wherein the bucket is mounted on a first or second stage turbine rotor wheel.

* * * * *